US008834201B2

(12) United States Patent
Miyawaki et al.

(10) Patent No.: US 8,834,201 B2
(45) Date of Patent: Sep. 16, 2014

(54) COAXIAL CONNECTOR

(71) Applicant: Yazaki Corporation, Tokyo (JP)

(72) Inventors: Koji Miyawaki, Susono (JP); Hidenori Kanda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/778,487

(22) Filed: Feb. 27, 2013

(65) Prior Publication Data

US 2013/0224997 A1 Aug. 29, 2013

(30) Foreign Application Priority Data

Feb. 29, 2012 (JP) ..... 2012-044542

(51) Int. Cl.

| | |
|---|---|
| ***H01R 9/05*** | (2006.01) |
| ***H01R 24/38*** | (2011.01) |
| ***H01R 24/40*** | (2011.01) |
| *H01R 4/18* | (2006.01) |
| *H01R 24/44* | (2011.01) |

(52) U.S. Cl.

CPC *H01R 9/05* (2013.01); *H01R 4/185* (2013.01); *H01R 24/38* (2013.01); *H01R 9/0518* (2013.01); *H01R 24/40* (2013.01); *H01R 4/184* (2013.01); *H01R 24/44* (2013.01)

USPC ..... 439/585; 439/607.5

(58) Field of Classification Search

USPC ..... 439/585, 680, 607.48, 607.5, 877

See application file for complete search history.

(56) References Cited

U.S. PATENT DOCUMENTS

| | | | | |
|---|---|---|---|---|
| 6,808,417 | B2 * | 10/2004 | Yoshida | 439/585 |
| 7,140,914 | B2 * | 11/2006 | Kojima | 439/585 |
| 8,079,870 | B2 * | 12/2011 | Nakamura et al. | 439/585 |

FOREIGN PATENT DOCUMENTS

JP 2010-140808 A 6/2010

* cited by examiner

*Primary Examiner* — Neil Abrams
*Assistant Examiner* — Travis Chambers
(74) *Attorney, Agent, or Firm* — Sughrue Mion, PLLC

(57) ABSTRACT

A coaxial connector has a structure in which slits into which the both sides of a core wire crimp part are to be inserted are respectively formed on facing inner walls of a core wire containing groove in an inner housing and the core wire crimp part is covered with the inner housing and a terminal fitting by crimping of the terminal fitting.

2 Claims, 5 Drawing Sheets

COAXIAL CONNECTOR

BACKGROUND OF THE INVENTION

1. Field of the Invention

The present invention relates to a coaxial connector to be connected to a terminal of a coaxial wire, and more particularly to a coaxial connector allowing improvement of high frequency performance.

2. Related Background of the Invention

FIG. 8 and FIG. 9 illustrate an existing coaxial connector 100 disclosed in Patent Document 1. The coaxial connector 100 is adapted to be connected to a terminal of a coaxial wire 110 and is formed by including an inner terminal 120, an inner housing 130 and a terminal fitting 140.

The coaxial wire 110 is formed by a core wire 111, an insulating inner cover 112 which covers the outer periphery of the core wire 111, a braided wire 113 which covers the outer periphery of the insulating inner cover 112 and an insulating outer cover 114 which covers the outer periphery of the braided wire 113. The insulating outer cover 114 is peeled and the braided wire 113 is folded back on the outer periphery of the insulating outer cover 114, and the insulating inner cover 112 is peeled to be connected to the coaxial connector 100 in a state where the core wire 111 is exposed.

The inner terminal 120 is adapted to be connected to a terminal of the core wire 111 of the coaxial wire 110, and a core wire crimp part 121 which is crimped and connected to the terminal of the core wire 111 is formed in the inner terminal 120. A leading end of the inner terminal 120 is configured as a mating terminal connection part 122 to which a mating terminal is to be connected.

The inner housing 130 is formed into a cylindrical shape with an insulating resin and the inner terminal 120 is to be contained in the inner housing 130. In the inner terminal 120 which is contained in the inner housing 130, the mating terminal connection part 122 is situated on a leading end part of the inner housing 130. In the existing coaxial connector 100, the core wire crimp part 121 which is a connection part between the terminal of the core wire 111 and the inner terminal 120 is situated on the outside of the inner housing 130 and is not contained in the inner housing 130.

The terminal fitting 140 has a laterally elongated bottom plate part 141, and an inner housing containing cylinder part 142, an inner housing crimp part 143, a braided wire crimp part 144 and an insulating outer cover crimp part 145 are formed in order from the leading end side (the left end side in FIG. 8 and FIG. 9) toward the trailing end side (the right end side in FIG. 8 and FIG. 9) of the bottom plate part 141.

The inner housing 130 is in a state of containing the inner terminal 120 to which the terminal of the core wire 111 is connected for the terminal fitting 140. The inner housing 130 is slid along a length-wise direction of the bottom plate part 141 of the terminal fitting 140 in the state of containing the inner terminal 120, and thereby the inner housing 130 is assembled to the terminal fitting 140. In this assembling, a leading end part of the inner housing 130 is inserted into the inner housing containing cylinder part 142. Then, swaging is performed to crimp the inner housing crimp part 143 to the inner housing 130, to crimp the braided wire crimp part 144 to the braided wire 113 of the coaxial wire 110 and to crimp the insulating outer cover crimp part 145 to the insulating outer cover 114 of the coaxial wire 110. The inner housing 130 and the coaxial wire 110 are fixed to the terminal fitting 140 with the aid of crimping thereof, and thereby the coaxial connector 100 is assembled.

PRIOR ART DOCUMENT

Patent Document

[Patent Document 1] Japanese Patent Laid-Open No. 2010-140808

SUMMARY OF THE INVENTION

However, in the existing coaxial connector 100, too many parts are left open in a state where the terminal fitting 140 has been crimped by swaging and, in particular, the core wire crimp part 121 which is the connection part between the terminal of the core wire 111 and the inner terminal 120 is in a state of being exposed to the outside and is not covered. Therefore, such a disadvantage occurs that the high frequency performance is deteriorated.

Therefore, the present invention aims to provide a coaxial connector which surely covers a connection part between a terminal of a core wire and an inner terminal to improve the high frequency performance.

The invention according to claim 1 is a coaxial connector to which a terminal of a coaxial wire which includes a core wire, a braided wire covering an outer periphery of the core wire via an insulating inner cover and an insulating outer cover covering an outer periphery of the braided wire is to be connected, and characterized by including: an inner terminal to be connected to a terminal of the core wire and to be connected to a mating terminal; an inner housing in which the inner terminal is to be contained together with the terminal of the core wire; and a terminal fitting formed by a crimp part to which the braided wire and the insulating outer cover of the coaxial wire are to be crimped and a body part to which the inner housing is to be fixed in a state of containing the inner terminal, wherein in the inner housing, in a housing body which is formed by a terminal connection side containing part into which a mating terminal connection part of the inner terminal is to be inserted and a core wire crimp part containing part in which a core wire crimp part to which the inner terminal and the terminal of the core wire are crimped is to be contained and which is to be fixed to the terminal fitting by crimping of the terminal fitting, a core wire containing groove which is disposed to be contiguous with the terminal connection side containing part and the core wire crimp part containing part and in which the core wire crimp part and the inner terminal are to be contained is formed, slits into which the both sides of the core wire crimp part are to be inserted are respectively formed in facing inner walls of the core wire containing groove, and the core wire crimp part is to be covered with the inner housing and the terminal fitting by crimping of the terminal fitting.

The invention according to claim 2 is the coaxial connector according to claim 1 and characterized in that the body part of the terminal fitting is formed by a crimp part for inner housing which is to be crimped to the inner housing and an inner housing containing cylinder part for containing the inner housing, the crimp part of the terminal fitting is formed by an insulating outer cover crimp part to which the insulating outer cover is to be crimped and a braided wire crimp part to which the braided wire is to be crimped, and the crimp part for inner housing is disposed on the side opposite to the insulating outer cover crimp part with the braided wire crimp part sandwiched therebetween.

DESCRIPTION OF THE PREFERRED EMBODIMENTS

Figure 1:
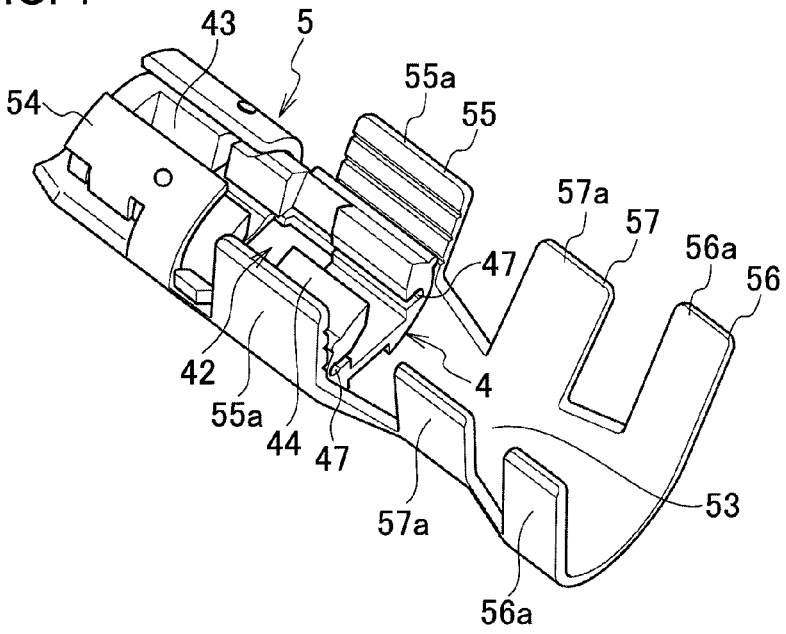
FIG. 1 is a perspective view illustrating an assembling state of a terminal fitting and an inner housing of a coaxial connector according to one embodiment of the present invention.
Figure 2:
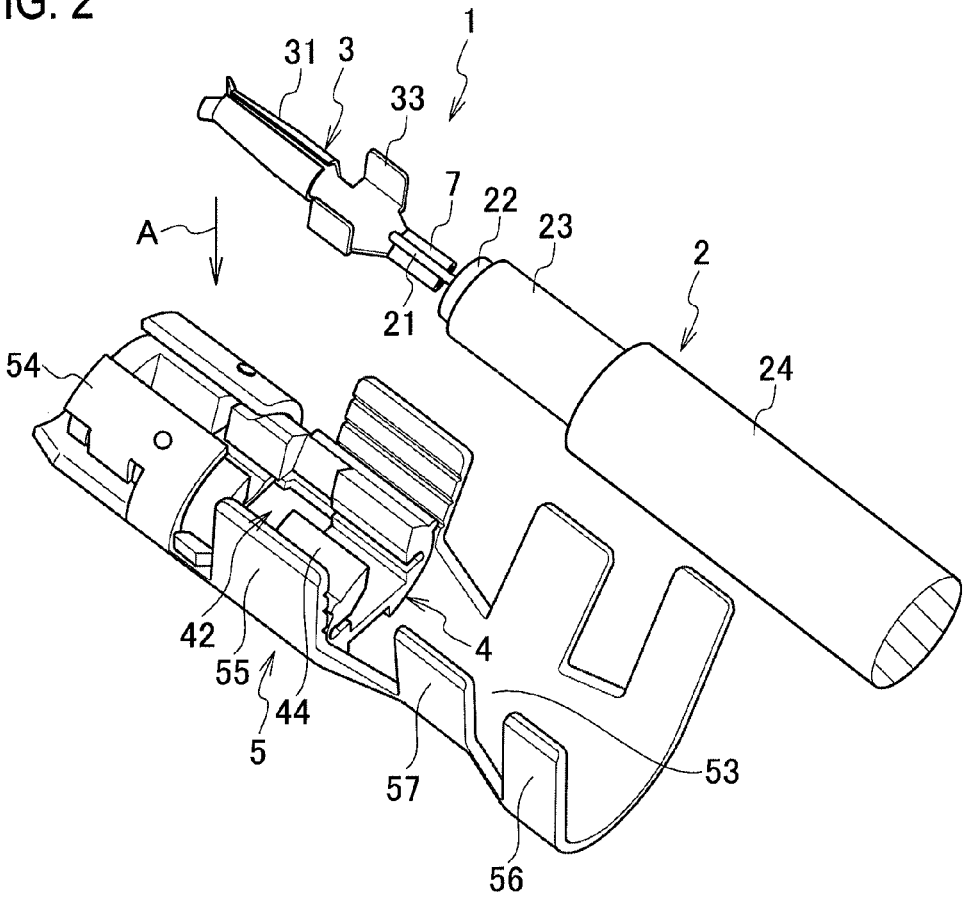
FIG. 2 is a perspective view illustrating a state of assembling an inner terminal which is connected to a coaxial wire.
Figure 3:
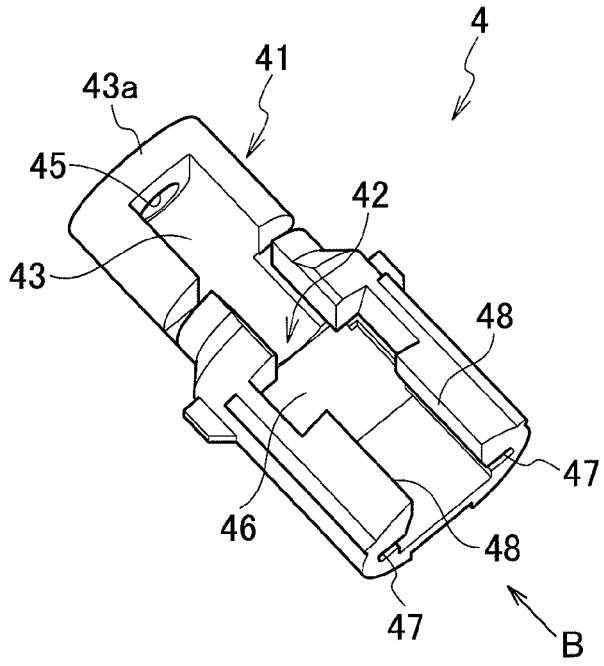
FIG. 3 is a perspective view illustrating the inner housing.
Figure 4:
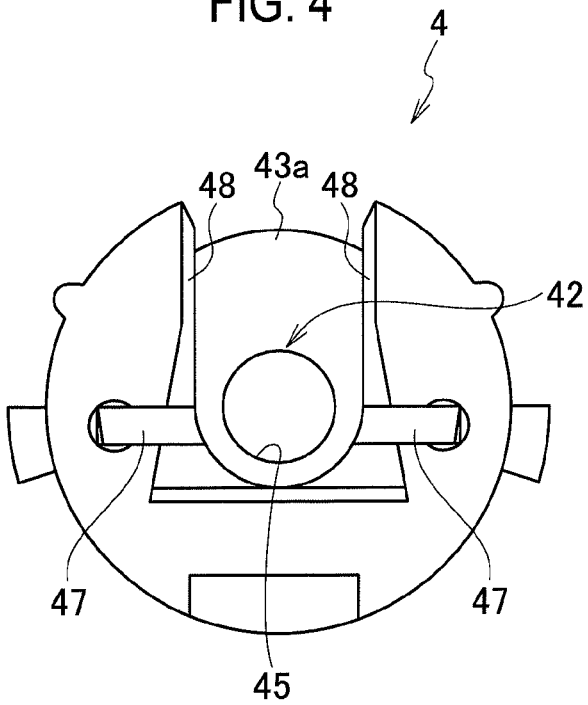
FIG. 4 is an end face view viewed from a direction of an arrow B in FIG. 3.
Figure 5:
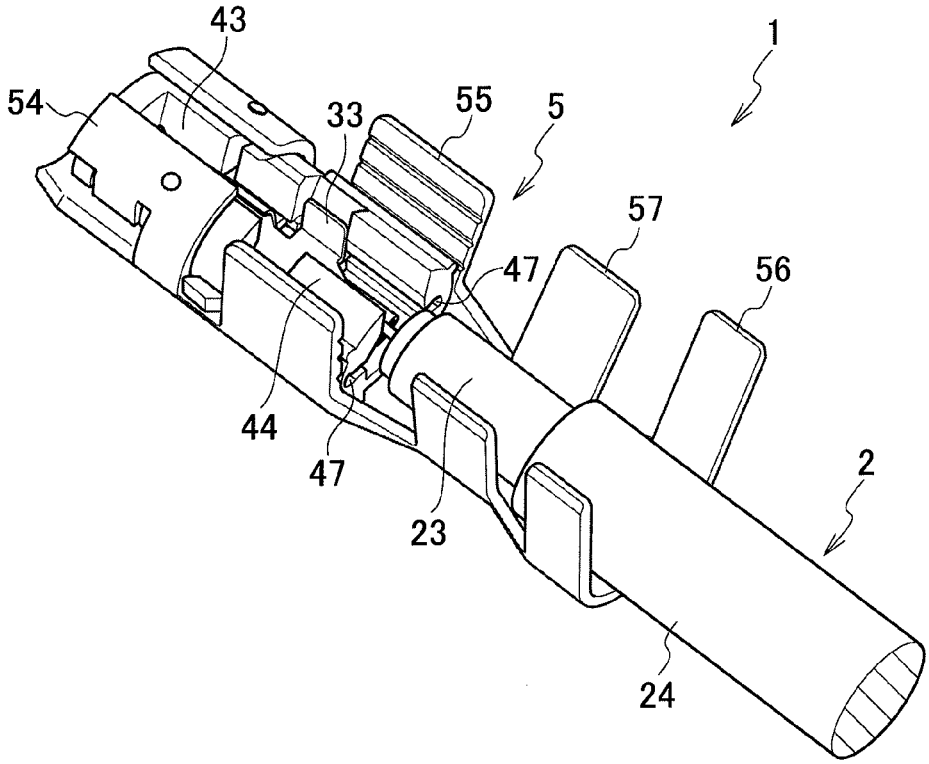
FIG. 5 is a perspective view illustrating a state before the terminal fitting is crimped.
Figure 6:
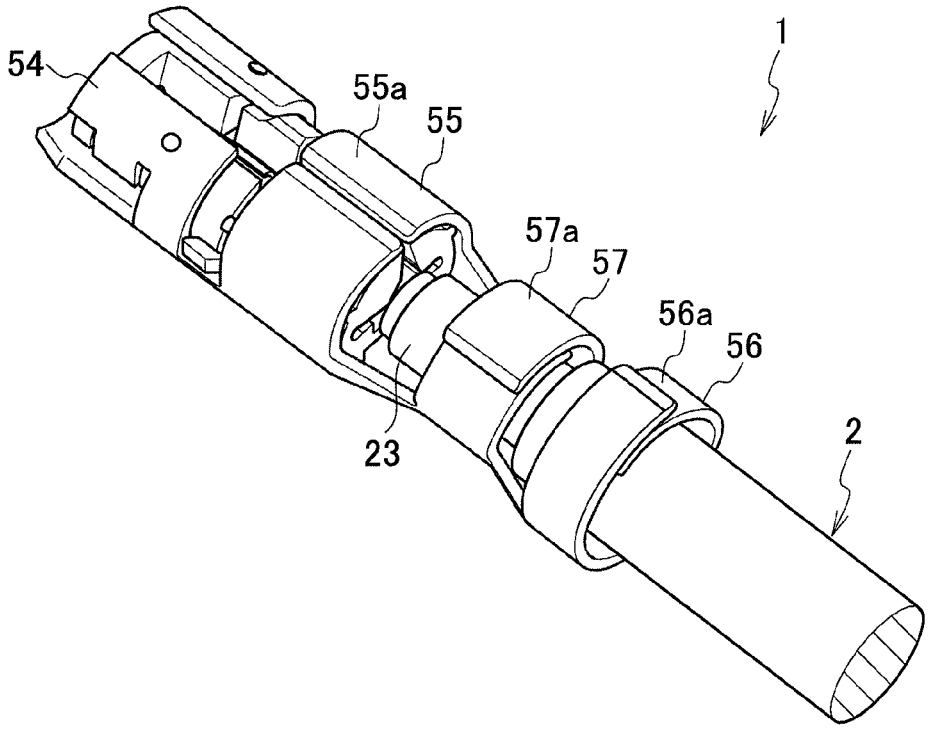
FIG. 6 is a perspective view illustrating a state of having crimped the terminal fitting.
Figure 7:
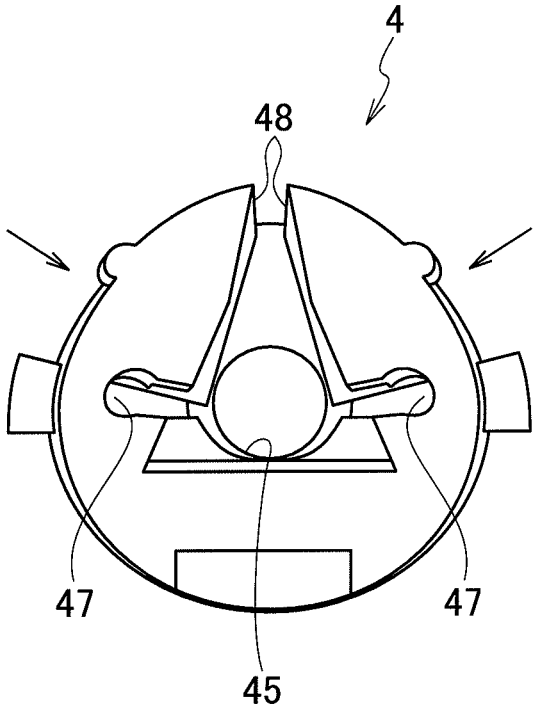
FIG. 7 is an end face view illustrating a state of the inner housing after the terminal fitting has been crimped.
Figure 8:
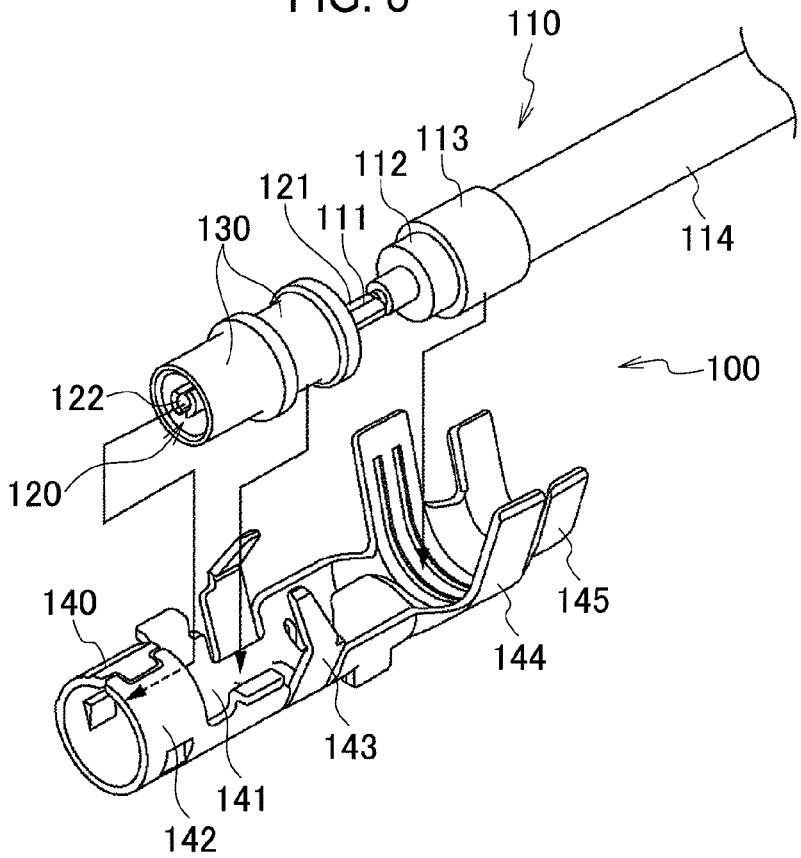
FIG. 8 is a perspective view illustrating a state before an existing coaxial connector is assembled.
Figure 9:
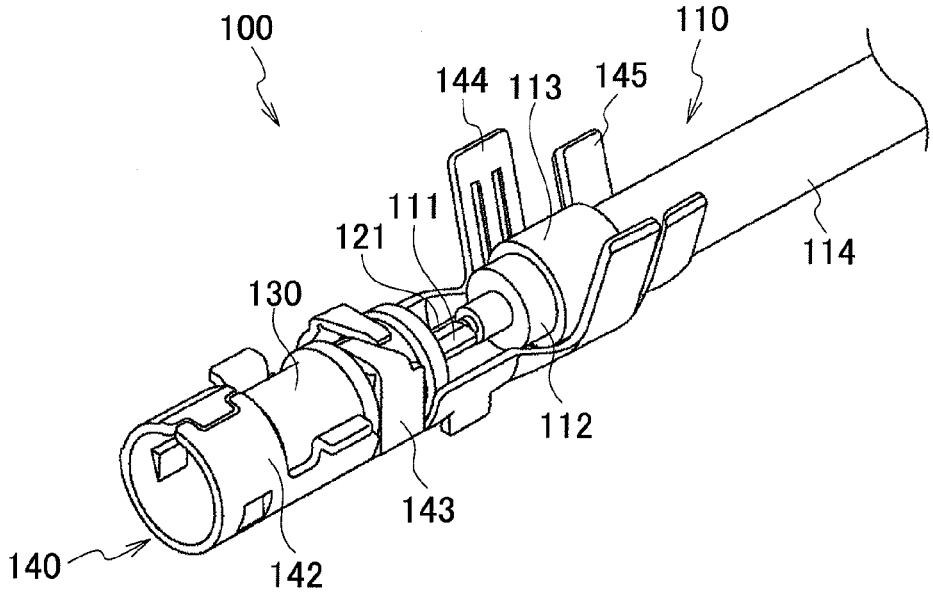
FIG. 9 is a perspective view illustrating an assembling state of the existing coaxial connector.

In the following, the present invention will be more specifically described using one embodiment illustrating the present invention. FIG. 1 is a perspective view illustrating an assembling state of a terminal fitting 5 and an inner housing 4 of a coaxial connector 1 according to one embodiment of the present invention. FIG. 2 is a perspective view illustrating a state of assembling an inner terminal 3 which is connected to a coaxial wire 2. FIG. 3 is a perspective view illustrating the inner housing 4. FIG. 4 is an end face view viewed from a direction of an arrow B in FIG. 3. FIG. 5 is a perspective view illustrating a state before the terminal fitting 5 is crimped. FIG. 6 is a perspective view illustrating a state of having crimped the terminal fitting 5. FIG. 7 is an end face view illustrating a state of the inner housing 4 after the terminal fitting 5 has been crimped.

The coaxial connector 1 is formed by the inner terminal 3 to be connected to the coaxial wire 2, the inner housing 4 for containing the inner terminal 3 and the terminal fitting 5 for fixing the coaxial wire 2 and the inner housing 4 as illustrated in FIG. 2.

The coaxial wire 2 includes a core wire 21 formed by twisting together a plurality of electrically conductive element wires, an insulating inner cover 22 disposed to cover the outer periphery of the core wire 21 and made of a dielectric, a braided wire 23 formed by braiding element wires similar to those in the core wire 21 in the net-like form and disposed to cover the outer periphery of the insulating inner cover 22 and an insulating outer cover 24 covering the outer periphery of the braided wire 23 and made of an insulating resin as illustrated in FIG. 2. The core wire 21 transmits a high frequency signal and the braided wire 23 shields electromagnetic waves. In such the coaxial wire 2, the insulating outer cover 24 is peeled to expose the braided wire 23, the insulating inner cover 22 is peeled to expose the core wire 21 and the terminal parts are connected to the coaxial connector 1 in the exposed states.

The inner terminal 3 is to be connected to the terminal of the core wire 21 and to be connected to a mating terminal (not illustrated). The leading end side (the left end side) of the inner terminal 3 is configured as a mating terminal connection part 31 to be connected to the mating terminal and the trailing end side (the right end side) of the inner terminal 3 is configured as a core wire crimp part 7 to which the terminal of the core wire 21 is to be connected as illustrated in FIG. 2. The core wire crimp part 7 is apart which is in a state where it is connected to the terminal of the core wire 21 by being swaged and crimped in a state where the terminal of the core wire 21 is inserted into the core wire crimp part 7.

The inner terminal 3 according to the present embodiment is provided with an impedance adjustment part 33. The impedance adjustment part 33 is formed into a substantially U-shape and is disposed between the mating terminal connection part 31 and the core wire crimp part 7. The impedance adjustment part 33 fits into the inner housing 4 (an impedance adjustment part containing part 46 of the inner housing 4) and acts to position the inner terminal 3 relative to the inner housing 4 by the fit.

The inner housing 4 is a member in which the inner terminal 3 is to be contained together with the core wire 21 of the coaxial wire 2 and the entire of the inner housing 4 is formed of an insulating resin. The inner housing 4 is formed by a housing body 41 and a core wire containing groove 42 formed in the housing body 41 as illustrated in FIG. 3 and FIG. 4.

The housing body 41 includes a terminal connection side containing part 43 into which the mating terminal connection part 31 of the inner terminal 3 is to be inserted and a core wire crimp part containing part 44 in which the above-mentioned core wire crimp part 7 to which the inner terminal 3 and the terminal of the core wire 21 are crimped is to be contained. An insertion opening 45 which corresponds to the mating terminal connection part 31 of the inner terminal 3 is formed in a front wall part 43*a* of the terminal connection side containing part 43. In addition, the impedance adjustment part containing part 46 into which the impedance adjustment part 33 of the inner terminal 3 is to be fitted is formed between the terminal connection side containing part 43 and the core wire crimp part containing part 44.

The core wire containing groove 42 in the inner housing 4 is disposed to be contiguous with the terminal connection side containing part 43 and the core wire crimp part containing part 44. An upper face part of the core wire containing groove 42 is notched in a length-wise direction and the inner terminal 3 is dropped from the notched upper face part together with the core wire crimp part 7 and the inner terminal 3 and the core wire crimp part 7 are contained in the core wire containing groove 42 by the dropping.

In addition to the above, slits (bent slits) 47 are formed in the inner housing 4. The slits 47 are respectively formed in facing inner walls 48 of the core wire containing groove 42. In this embodiment, the facing inner walls 48 of the core wire containing groove 42 also serve as inner walls of the core wire crimp part containing part 44. Therefore, the slits 47 are formed in the core wire crimp part containing part 44 in this embodiment. The both sides of the core wire crimp part 7 are inserted into such the slits 47. The core wire crimp part 7 (the inner terminal 3) is fixed to the inner housing 4 by the insertion of the both sides of the core wire crimp part 7 into the slits 47. The both sides of the core wire crimp part 7 are bent integrally with the inner housing 4 along with bending stress acting on the inner housing 4 by so fitting the core wire crimp part 7 to the inner housing 4. Such the bending stress acting on the inner housing 4 acts by crimping of the terminal fitting 5 as described later.

The terminal fitting 5 is formed by folding an electrically conductive metal plate. The terminal fitting 5 includes a bottom plate part 53 extending in a length-wise direction as illustrated in FIG. 1 and FIG. 2. The leading end side (the left end side) of the bottom plate part 53 is configured as a body part 51 and the trailing end side (the right end side) thereof is configured as a crimp part 52.

The body part 51 of the terminal fitting 5 is a part to which the inner housing 4 which contains the inner terminal 3 is to be fixed. The body part 51 is formed by an inner housing containing cylinder part 54 which is situated on its leading end side and an inner housing crimp part 55 which is situated behind the inner housing containing cylinder part 54.

The inner housing containing cylinder part 54 has a circular cylindrical shape and is adapted to contain therein the terminal connection side containing part 43 of the inner housing 4. The inner housing crimp part 55 includes one pair of inner housing crimp strips 55*a* which stands upright behind the inner housing containing cylinder part 54. The inner housing 4 is fixed by swaging the inner housing crimp strips 55*a* to crimp them to the inner housing 4.

The crimp part 52 of the terminal fitting 5 is crimped to the insulating outer cover 24 and the braided wire 23 of the coaxial wire 2, and thereby the braided wire 23 and the insulating outer cover 24 are fixed to the terminal fitting 5. The crimp part 52 is formed with an insulating outer cover crimp part 56 and a braided wire crimp part 57 for this purpose. The insulating outer cover crimp part 56 includes one pair of insulating outer cover crimp strips 56*a* which stands upright from the both sides of the bottom plate part 53 and the pair of insulating outer cover crimp strips 56*a* is crimped to the insulating outer cover 24 of the coaxial wire 2 to fix the insulating outer cover 24 to the terminal fitting 5.

The braided wire crimp part 57 includes one pair of braided wire crimp strips 57*a* which stands upright from the both sides of the bottom plate part 53. The one pair of braided wire crimp strips 57*a* is crimped to the braided wire 23 of the coaxial wire 2 to fix the braided wire 23 to the terminal fitting 5.

In this case, the braided wire crimp part 57 is disposed between the inner housing crimp part 55 and the insulating outer cover crimp part 56 so as to be sandwiched therebetween. Since the braided wire crimp part 57 is disposed as mentioned above, the braided wire 23 of the coaxial wire 2 which is crimped to the braided wire crimp part 57 does not strike against the inner housing crimp part 55 and the insulating outer cover crimp part 56 and breaking of braided wire that the braided wire 23 has been untied does not occur. Therefore, it is possible to avoid occurrence of a short between the core wire 21 and the braided wire 23 caused by contact of the braided wire breaking with the core wire 21.

Next, assembling of the coaxial connector 1 according to the present embodiment will be described.

First, the inner housing 4 is assembled to the terminal fitting 5 as illustrated in FIG. 1. In the assembling, the inner housing 4 is assembled to the terminal fitting 5 so that the housing body 41 is inserted into the inner housing containing cylinder part 54. The core wire crimp part containing part 44 of the inner housing 4 is situated on the inner housing crimp part 55 of the terminal fitting 5 by the assembling. In addition, in an assembled state, an open part of the core wire containing groove 42 in the inner housing 4 is in an upward facing state.

On the other hand, in the coaxial wire 2, the inner terminal 3 is crimped to the terminal of the core wire 21 to form the core wire crimp part 7 on the inner terminal 3 so as to establish a state that the inner terminal 3 and the core wire 21 of the coaxial wire 2 are connected together by the core wire crimp part 7.

Then, an assy (assembly) of the inner terminal 3 and the coaxial wire 2 is assembled to the terminal fitting 5 to which the inner housing 4 is attached as illustrated in FIG. 2. The assembling is performed by dropping the assy (assembly) of the inner terminal 3 and the coaxial wire 2 as indicated by an arrow A in FIG. 2. Such the dropping is performed in a state where the mating terminal connection part 31 of the inner terminal 3 is situated on the terminal connection side containing part 43 of the inner housing 4, the impedance adjustment part 33 of the inner terminal 3 is situated on the impedance adjustment part containing part 46 of the inner housing 4 and the core wire crimp part 7 of the inner terminal 3 is situated on the core wire crimp part containing part 44 of the inner housing 4 as illustrated in FIG. 5. Simultaneously with this, the braided wire 23 of the coaxial wire 2 is situated on the braided wire crimp part 57 of the terminal fitting 5 and the insulating outer cover 24 of the coaxial wire 2 is situated on the insulating outer cover crimp part 56 of the terminal fitting 5.

The both sides of the core wire crimp part 7 of the inner terminal 3 are inserted into the slits 47 formed in the inner housing 4 by the above-described dropping. The core wire crimp part 7 is surely fixed to the inner housing 4 and is not removed from the inner housing 4 by the insertion into the slits 47.

FIG. 6 illustrates a state which follows the state in FIG. 5, that is, a state that the terminal fitting 5 has been crimped. Crimping of the terminal fitting 5 is performed by crimping the inner housing crimp part 55 to the core wire crimp part containing part 44 of the inner housing 4, by crimping the braided wire crimp part 57 to the braided wire 23 of the coaxial wire 2 and by crimping the insulating outer cover crimp part 56 to the insulating outer cover 24 of the coaxial wire 2. The braided wire 23 and the insulating outer cover 24 are fixed to the terminal fitting 5 and the terminal fitting 5 is connected to the braided wire 23 by the crimping to the braided wire 23 and the insulating outer cover 24.

In addition, bending stress acts on the core wire crimp part containing part 44 by crimping the inner housing crimp part 55 to the core wire crimp part containing part 44 of the inner housing 4. This bending stress acts in a bending direction that the core wire crimp part containing part 44 is compressed from the both sides of the containing part 44. Therefore, the slits 47 formed in the core wire crimp part containing part 44 are also bent in the same direction. FIG. 7 illustrates such a bent state.

The core wire crimp part 7 the both sides of which are inserted into the slits 47 is also bent integrally by the bending of the slits 47. Together with the bending, the core wire crimp part 7 is held in a state of being covered with the core wire crimp part containing part 44 of the inner housing 4 and further the core wire crimp part containing part 44 is held in a state of being covered with the inner housing crimp part 55 of the terminal fitting 5. A connection part between the inner terminal 3 and the core wire 21 is surely covered and is not exposed by the covering of the core wire crimp part 7 with the core wire crimp part containing part 44 of the inner housing 4 and also by the covering of the core wire crimp part containing part 44 with the inner housing crimp part 55 of the terminal fitting 5 as mentioned above. As a result, it is possible to improve the high frequency performance.

In addition, according to the present embodiment, the braided wire 23 of the coaxial wire 2 does not strike against the inner housing crimp part 55 and the insulating outer cover crimp part 56 of the terminal fitting 5 and breaking of braided wire does not occur. Therefore, the braided wire breaking does not contact the core wire 21 and hence it is possible to avoid occurrence of a short between the braided wire 23 and the core wire 21.

The present invention is not limited to the above-mentioned embodiment and may be modified in a variety of ways. For example, as long as the slits 47 in the inner housing 4 are configured to allow insertion of the both sides of the core wire crimp part 7 of the inner terminal 3 into them, the slits 47 may be formed in another part such as the terminal connection side containing part 43 or the like of the inner housing 4, without forming the slits 47 in the core wire crimp part containing part 44. In addition, in the inner terminal 3, the impedance adjustment part 33 may be omitted.

The present application claims priority based on Japanese Patent Application No. 2012-044542, filed on Feb. 29, 2012, the content of which is hereby incorporated by reference into this application.

The coaxial connector according to the present invention has a structure that the core wire containing groove in which the core wire crimp part to which the inner terminal and the terminal of the core wire are crimped is to be contained is formed in the inner housing and the both sides of the core wire crimp part are to be inserted into the slits formed on the facing inner walls of the core wire containing groove, and thereby the core wire crimp part is surely fixed to the inner housing. Therefore, the core wire crimp part is not removed from the inner housing. Then the core wire crimp part is held in a state of being covered with the inner housing and the terminal fitting by crimping the terminal fitting in a state where the both sides of the core wire crimp part are inserted into the slits. Therefore, it is possible to surely cover the connection part between the inner terminal and the terminal of the core wire, and thereby it is possible to improve the high frequency performance.

Since the inner housing crimp part of the terminal fitting is disposed on the side opposite to the insulating outer cover crimp part with the braided wire crimp part sandwiched between them, the braided wire crimp part is held in a state of being sandwiched between the inner housing crimp part and the insulating outer cover crimp part. In such the state, the braided wire of the coaxial wire which is crimped to the braided wire crimp part does not strike against the inner housing crimp part and the insulating outer cover crimp part and breaking of braided wire that the braided wire has been untied does not occur. Therefore, the braided wire breaking does not contact the core wire and hence it is possible to avoid occurrence of a short between the core wire and the braided wire.

DESCRIPTION OF REFERENCE NUMERALS OR SYMBOLS

1: coaxial connector
2: coaxial wire
3: inner terminal
4: inner housing
5: terminal fitting
7: core wire crimp part
21: core wire
22: insulating inner cover
23: braided wire
24: insulating outer cover
31: mating terminal connection part
33: impedance adjustment part
41: housing body
42: core wire containing groove
43: terminal connection side containing part
44: core wire crimp part containing part
47: slit
48: inner wall
51: body part
52: crimp part
53: bottom plate part
54: inner housing containing cylinder part
55: inner housing crimp part
56: insulating outer cover crimp part
57: braided wire crimp part.

What is claimed is:

1. A coaxial connector to which a terminal of a coaxial wire which includes a core wire, a braided wire covering an outer periphery of the core wire via an insulating inner cover and an insulating outer cover covering an outer periphery of the braided wire is to be connected, comprising:

an inner terminal to be connected to a terminal of the core wire and to be connected to a mating terminal;

an inner housing in which the inner terminal is to be contained together with the terminal of the core wire; and a terminal fitting formed by a crimp part to which the braided wire and the insulating outer cover of the coaxial wire are to be crimped and a body part to which the inner housing is to be fixed in a state of containing the inner terminal, wherein in the inner housing, in a housing body which is formed by a terminal connection side containing part into which a mating terminal connection part of the inner terminal is to be inserted and a core wire crimp part containing part in which a core wire crimp part to which the inner terminal and the terminal of the core wire are crimped is to be contained and which is to be fixed to the terminal fitting by crimping of the terminal fitting, a core wire containing groove which is disposed to be contiguous with the terminal connection side containing part and the core wire crimp part containing part and in which the core wire crimp part and the inner terminal are to be contained is formed, slits into which the both sides of the core wire crimp part are to be inserted are respectively formed in facing inner walls of the core wire containing groove, and the core wire crimp part is to be covered with the inner housing and the terminal fitting by crimping of the terminal fitting.

2. The coaxial connector according to claim 1, wherein the body part of the terminal fitting is formed by a crimp part for inner housing which is to be crimped to the inner housing and an inner housing containing cylinder part for containing the inner housing, the crimp part of the terminal fitting is formed by an insulating outer cover crimp part to which the insulating outer cover is to be crimped and a braided wire crimp part to which the braided wire is to be crimped, and the crimp part for inner housing is disposed on the side opposite to the insulating outer cover crimp part with the braided wire crimp part sandwiched therebetween.

* * * * *